United States Patent [19]

Scarpa et al.

[11] Patent Number: 4,869,486

[45] Date of Patent: Sep. 26, 1989

[54] METHOD AND APPARATUS FOR FEEDING CARTON BLANKS

[75] Inventors: Eric W. Scarpa, Cincinnati, Ohio; Richard J. Speed, Villa Hills, Ky.

[73] Assignee: R. A. Jones & Co. Inc., Covington, Ky.

[21] Appl. No.: 145,139

[22] Filed: Jan. 19, 1988

[51] Int. Cl.[4] ..... B65H 5/22; B65H 3/04; B65H 1/02

[52] U.S. Cl. ..... 271/3.1; 271/34; 271/94; 271/150

[58] Field of Search ..... 271/3.1, 34, 149, 150, 271/151, 202, 220, 265, 270, 94, 96

[56] References Cited

U.S. PATENT DOCUMENTS

| | | | |
|---|---|---|---|
| 3,429,570 | 2/1969 | Scully . | |
| 3,776,544 | 12/1973 | Watson et al. | 271/3 |
| 3,894,732 | 7/1975 | Muller | 271/10 |
| 3,945,633 | 3/1976 | Knopp | 271/202 X |
| 4,093,207 | 6/1978 | Greenwell et al. | 271/3.1 |
| 4,478,400 | 10/1984 | Commers | 271/3.1 |

*Primary Examiner*—Joseph J. Rolla
*Assistant Examiner*—Mona Beegle
*Attorney, Agent, or Firm*—Wood, Herron & Evans

[57] ABSTRACT

Method and apparatus for feeding carton blanks to a side seam gluer. The blanks are removed from the discharge end of a conveyor by a friction belt so as to shingle the blanks. The shingled blanks are delivered to a feed hopper in such a way that the feed hopper maintains a constant height of carton blanks. The blanks are fed, one at a time, from the feed hopper.

3 Claims, 1 Drawing Sheet

METHOD AND APPARATUS FOR FEEDING CARTON BLANKS

BACKGROUND OF THE INVENTION

This invention relates to a carton blank feeder, and more particularly, to a carton blank feeder for a side seam gluer of the type that forms blanks into flat folded cartons and feeds them continuously to a cartoner.

The problem of feeding carton blanks is that the blanks, when stacked together, are quite heavy. The weight of the stack makes difficult the stripping off of blanks, one at a time, to feed them into a side seam gluer. Yet it is desirable to have a large stack so that an operator is not required to be in constant attendance continuously loading small groups of blanks into the magazine in order to keep the weight off the discharge end of the magazine. Compounding the problem is that the cut edges of the cartons tend to interlock, thereby adding to the difficulty of feeding blanks in a uniform manner.

One approach to a solution to the problem is shown in U.S. Pat. No. 4,093,207 assigned to the assignee of the present invention. In that patent, there is disclosed an upper magazine and a lower magazine or feed hopper. In the upper magazine, a large stack of blanks is supported on two spaced rollers at the lower discharge end of the upper magazine. The rollers rotate on demand from the lower stack and feed small groups of blanks onto the lower stack. A feeding mechanism is provided to remove the blanks one at a time from the lower stack. While this blank feeding mechanism has proved generally satisfactory, it, too, has a problem. The tendency of the blanks to interlock at their rough edges makes it difficult for the rollers at the lower end of the upper magazine to feed blanks in very small numbers to the lower stack. Sometimes a chunk of blanks that may be an inch thick will drop through. That chunk shakes the machine, and the somewhat sensitive feeder is caused to misfeed. If nothing else, misfeeding a blank disrupts the operation of the cartoner downstream from the side seam gluer.

In another type of feeder, a horizontal friction belt pulls blanks, one at a time, off the bottom of a stack and feeds them past a metering blade that permits only one blank to pass the blade. The need for the blanks to slide off the bottom of the stack requires preconditioning (fanning) of the blanks as they are added to the stack and constant operator attendance to more or less continuously "nudge" the stack to assure constant feeding.

BRIEF DESCRIPTION OF THE INVENTION

An objective of the present invention has been to improve the feeder for carton blanks.

A further objective of the invention has been to provide a main magazine, a feed hopper, and a mechanism for delivering the blanks from the main magazine to the feed hopper in such a way that there is maintained a uniformly thick, small stack of blanks in the feed hopper.

The foregoing objectives of the invention are attained by providing a friction belt for stripping off blanks from a supply and delivering them in shingled fashion to a feed hopper. By delivering the cartons in shingled fashion to the feed hopper, a uniform thickness of the stack in the feed hopper can be maintained and shock to the feed hopper of dropping chunks of blanks in it is eliminated.

In the preferred form of the invention, the main magazine consists of a generally horizontal conveyor that is slightly inclined so that the blanks lean toward the discharge end of the conveyor. The blanks are stacked on the horizontal conveyor in a generally vertical attitude. A friction belt has a run that extends generally vertically past the discharge end of the horizontal conveyor and strips blanks from the discharge end in shingled fashion and moves them in a upward direction. Immediately adjacent the upper end of the friction belt is a feed hopper into which the shingled cartons are delivered. Control mechanism is provided to maintain a uniform delivery of the shingled cartons so that the height or thickness of the stack in the feed hopper is uniformly maintained. A feeding mechanism is associated with the feed hopper for pulling off cartons one at a time and feeding them to a side seam gluer.

In the preferred form of the invention, a flexible guide or belt overlies the upper end of the friction belt so as to guide the shingled blanks into the feed hopper. That guide has a lower pulley that is spaced from the upper end of the friction belt and is movable toward and away from it. A detector monitors the movement of the pulley and is used to control the operation of the horizontal conveyor to keep the pitch of shingling constant. It has been found that the pitch is dependent upon the pressure of the cartons at the discharge end on the friction belt. That pressure is dependent upon the operation of the horizontal conveyor. If the pitch is too small, the flow of shingled cartons will be too thick past the roller causing it to swing away from the friction belt. The detector will signal a clutch on the horizontal conveyor to slow the horizontal conveyor, thereby reducing the pressure and returning the shingling to the desired pitch.

In an alternative form of the invention, an upper magazine contains the main stack of blanks. The stack rests on rollers at the discharge end of the main stack and feeds chunks of blanks into a lower magazine similar to the system disclosed in U.S. Pat. No. 4,093,207. A friction belt has a run that passes under the bottom of the lower stack and strips blanks in shingled fashion off the lower stack to deliver them to a horizontal feed hopper. Under that hopper, a reciprocating suction cup and feed mechanism feeds the blanks as disclosed in the '207 patent. In this embodiment, the stack in the hopper will be maintained at a uniform height of about one inch so that they may easily be fed. An added advantage is that the mechanism below is easily accessible merely by lifting the one inch stack.

BRIEF DESCRIPTION OF THE DRAWINGS

The several features of the invention will become more readily apparent when taken in conjunction with the accompanying drawings in which.

DETAILED DESCRIPTION

Figure 1:
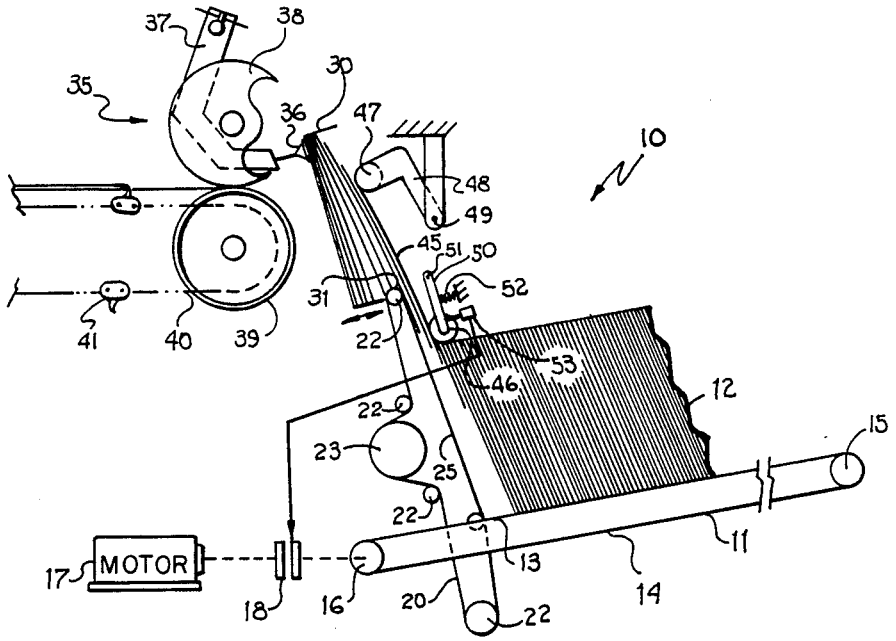
FIG. 1 is a diagrammatic side elevational view of a preferred form of the invention.

Referring to FIG. 1, a carton feed mechanism 10 includes a generally horizontal conveyor 11 that is inclined downwardly at about 15° to support vertical carton blanks 12 in such a way that the carton blanks lean toward the discharge end 13 of the conveyor. The conveyor preferably consists of a pair of endless chains 14 of the type disclosed in application Ser. No.

07/040,837. The chains pass around pulleys 15 and 16, with pulley 16 being driven by a motor 17 through a clutch 18.

An endless friction belt 20 is disposed between the two conveyor chains 14. The friction belt is preferably an elastomer whose surface is covered by little nubbles that engage and frictionally retain the carton blanks forced against the surface of the belt by the pressure of the stack of blanks 12 leaning against it. (To illustrate shingling, a gap is shown between belt 20 and the lead blank 12. In practice, that gap would be closed by the blanks leaning against the belt.) The belt passes around idler pulleys 22 and a driving pulley 23. The belt presents a flat run 25 that is generally vertical and is located at the discharge end 13 of the conveyor 11.

A feed hopper 30 is positioned at the upper discharge end 31 of the belt 20 and receives blanks 12. The blanks 12 are maintained in a stack that is of uniform thickness and can be, for example one to four inches thick. A feeder 35 is associated with the hopper 30. It includes a suction cup 36 mounted on an oscillating arm 37. The suction cup oscillates in timed relation to a wheel 38 that cooperates with a wheel 39 and a feed chain 40 having lugs 41. With each stroke of the suction cup, the upper end of a blank 12 is pulled between the wheels 38 and 39. Those wheels capture the blank and thrust it in a horizontal direction in timed relation to the lugs 41 on the feed chains 40. The blank is thus captured and delivered to apparatus downstream for further processing as, for example, side seam gluing.

A pair of low friction guide belts 45 pass around pulleys 46, 47. The upper end of the belt is secured to a bell crank lever 48 that is pivoted at 49 to the machine frame. The pulley 46 is immediately adjacent the flat run 25 of the friction belt 20. It is mounted on a bracket 50 that is pivoted to the feeder frame at 51. The pulley 46 is urged by a spring 52 toward the flat run 25 of friction belt 20. A switch 53 monitors the position of the pulley 46. The switch 53 is connected to the clutch 18. The connection is such that when the pulley 46 swings away from the run 25 of the friction belt a distance sufficient to indicate that the pitch of the shingled blanks is too small, that is, the blanks are tending to be bunched up, the drive to the conveyor 11 will be declutched, thereby momentarily relieving the pressure.

Since it has been found that the shingling pitch is directly dependent upon the pressure of the incoming blanks against the friction belt, stopping the conveyor 11 decreases that pressure and the spacing or pitch between adjacent blanks will increase until the pulley 46 returns to a normal operating position.

The belt and pulley 47 combine to bend the upper ends of the blank into the upper end of the hopper 30.

In the operation of the invention, the conveyor 11 carries the stack of blanks 12 against the friction belt 20. The run 25 of the belt strips off blanks and delivers them upwardly in shingled fashion, preferably with a pitch of about one inch, into the feed hopper 30. The feed hopper 30 will maintain a stack about one inch or so thick. That uniformity of stack thickness promotes the feeding of blanks one at a time by the suction cup 36 and wheels 38 and 39.

Figure 2:
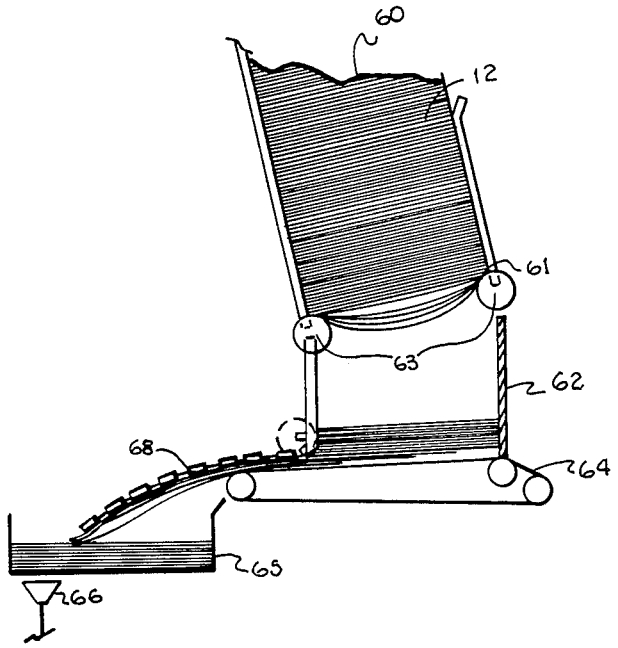
FIG. 2 is a diagrammatic side elevation view of an alternate form of the invention.

An alternative form of the invention is shown in FIG. 2. That magazine consists of a main stack 60 containing blanks 12. At the lower discharge end 61 of the magazine, the stack of blanks is supported on two spaced rollers 63. As viewed in FIG. 1, the left roller rotates clockwise and the right roller rotates counterclockwise to deliver chunks of blanks to a lower magazine 62. In the prior practice, a vacuum cup and feeder system was provided to feed blanks one at a time from below the lower magazine 62. That feeder is removed from that location and is replaced by a friction belt 64 of the type described in connection with friction belt 20. That friction belt deliver blanks from the lower magazine 62 in shingling fashion into a feed hopper 65. A vacuum cup and feeder mechanism 66 is provided below the feeder hopper to feed blanks out of the feeder hopper in a conventional manner to the side seam gluer.

Overlying the shingled blanks is a pair of low friction belts 68 similar to belts 45 of the previous embodiment. A chain overlies each belt to provide some weight that bends the blanks into the hopper 65.

From the above disclosure of the general principles of the present invention and the preceding detailed description of a preferred embodiment, those skilled in the art will readily comprehend the various modifications to which the present invention is susceptible. For example, the invention may be useful in feeding other types of stacked sheets such as leaflets, coupons and the like. Therefore, we desire to be limited only by the scope of the following claims and equivalents thereof:

We claim:

1. Apparatus for feeding blanks, one at a time, from a stack comprising:

a generally horizontal conveyor having a discharge end, a friction belt having a run extending generally vertically past said discharge end of said horizontal conveyor for picking up blanks, shingled fashion, and delivering them generally vertically, said friction belt having a discharge end, a substantially vertical feed hopper positioned adjacent the discharge end of said friction belt to receive said blanks in a substantially vertical orientation, and means for feeding blanks, one at a time, from said feed hopper.

2. Apparatus as in claim 1 further comprising:

a guide belt having a run spaced from a portion of the upper end of said friction belt to form a space between said friction belt and said guide belt through which shingled blanks pass, said guide belt passing around a horizontally movable pulley adjacent said friction belt, said pulley being movable in response to the thickness of the batch of shingled blanks passing by it, means for monitoring the movement of said pulley, and means responsive to the movement of said pulley to control the movement of said horizontal conveyor, thereby controlling the pressure of the blanks at the discharge end on said friction belt and hence controlling the pitch of shingling.

3. Apparatus as in claim 1 further comprising:

means for monitoring the thickness of the shingled group of cartons flowing into said feed hopper, and means connected to said monitoring means for stopping said horizontal conveyor when the said shingled cartons become thicker than a predetermined amount.

* * * * *